United States Patent [19]

Uhlig

[11] Patent Number: 4,762,248

[45] Date of Patent: Aug. 9, 1988

[54] TAMPER RESISTANT WIDE MOUTH PACKAGE

[75] Inventor: Albert R. Uhlig, Toledo, Ohio

[73] Assignee: Plastic Technologies, Toledo, Ohio

[21] Appl. No.: 48,905

[22] Filed: May 11, 1987

[51] Int. Cl.[4] ..... B65D 39/00

[52] U.S. Cl. ..... 220/307; 220/306

[58] Field of Search ..... 220/306, 307; 215/211, 215/224

[56] References Cited

U.S. PATENT DOCUMENTS 4,474,305 10/1984 Marco ..... 220/307

*Primary Examiner*—George T. Hall

*Attorney, Agent, or Firm*—Marshall & Melhorn

[57] ABSTRACT

A tamper resistant package is disclosed which comprises a container having a closed end, at least one side wall, and an open end defined by the side wall, the side walls having radially extending sealing surfaces, and a closure of plastic material such that the closure flexes in thin cross section. The closure has a depending annular skirt which is adapted to securely fit within the open end of the container. The depending annular skirt defines radially extending sealing surfaces for engaging the radially extending sealing surfaces of the container and for placing the container and closure under tension to secure the closure on the container. The closure is snapped into the open end of the container and is sealed under tension such that an attempt to disengage the closure from the container causes visual damage to either the closure or the container which can be seen by observing the package from the top. The tamper resistant package is especially useful for conducting urine specimen testing procedures.

29 Claims, 8 Drawing Sheets

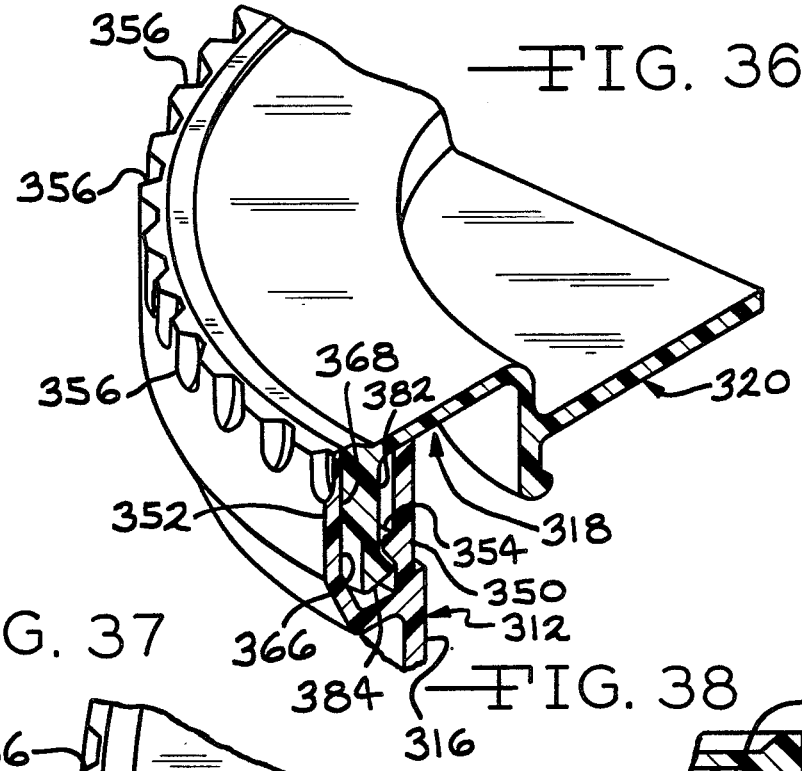
FIG. 36
FIG. 37
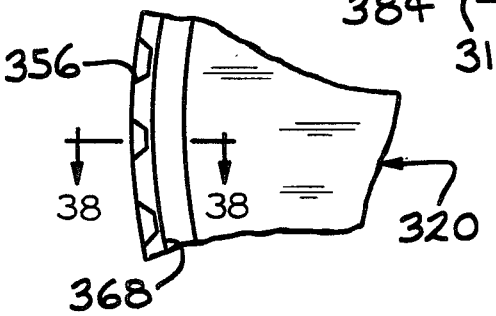
FIG. 38
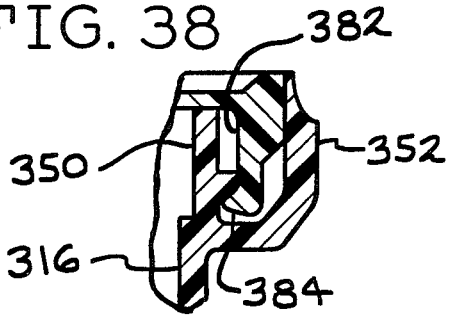
FIG. 39
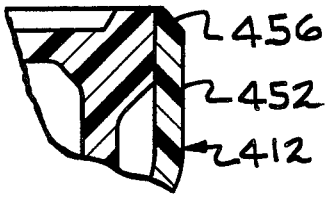
FIG. 40
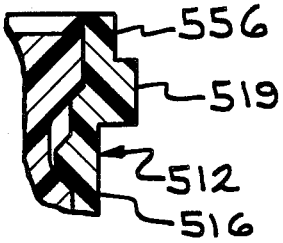
FIG. 42
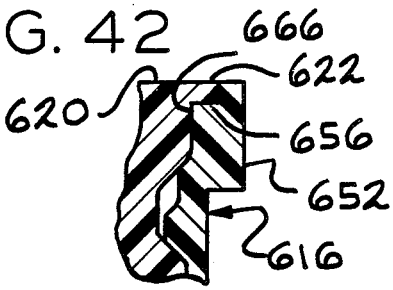
FIG. 41
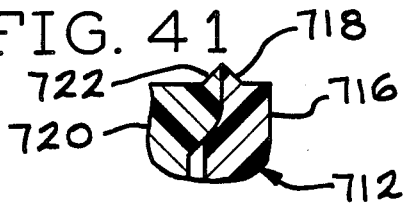

TAMPER RESISTANT WIDE MOUTH PACKAGE

BACKGROUND OF THE INVENTION

The invention relates to a tamper resistant wide mouth package which readily shows any evidence of tampering. More particularly, this invention relates to a tamper resistant package which includes a container and a closure for use in collecting a sample such that once a sample is collected in the container and the closure is attached to the container, the closure cannot be readily opened or removed from the container by anyone to permit tampering, contamination or accidental spillage of the sample. Any pilfering attempt to the package cannot be repaired. Alternatively, the tamper resistant wide mouth package of the present invention can be used in the medical, food and chemical industries.

There is now a great need for packages which are tamper resistant. As far as applicant is aware, no tamper resistant packages have been successfully used in the food or chemical fields or in sample collection which are of the snap-on type. Rather many packages are tamper protected with tamper indicating rings which are attached to a peripheral skirt of a closure and are torn or broken from the closure when the closure is removed. In such packages the evidence of pilfering attempts is shown on the side of the package. Therefore, each package must be turned and carefully inspected by hand; which careful inspection is often neglected. The sealing provisions of each package are rather limited and the bands can be easily repaired or the closure can be opened without visible tamper evidence to the band. Further, it is known that loose pilfer bands can be repaired.

For example, U.S. Pat. No. 4,024,976 discloses a package having a tamperproofing band molded integrally with the container. The band is positioned so that it encloses at least the bottom edge of the closure cap skin when the cap is applied to the container. This requires that at least a portion of the band be removed before the cap can be removed from the container.

U.S. Pat. No. 4,027,775 discloses a container and lid having a guard flange extending about the side wall of the container immediately below and outwardly beyond the skirt of the lid. The guard flange has weakened portions which provide a removable section which may be broken away to unshield a portion of the lid's skirt and removal of the lid.

U.S. Pat. No. 4,111,329 discloses a container having a tamperproof and stackable lid. The container has a radially extending flange which cooperates with the skirt of the cap to prevent the cap from being removed until a portion of the cap skirt is removed. The cap skirt comprises an upper portion and a lower portion with the lower portion forming a tear-off strip that is connected to the upper portion by means of vertically oriented stacking ribs. The ribs allow a plurality of caps to be stacked upon one another. The lower portion of the skirt defines an opening which enables the handler to insert a tool and then to tear the lower portion away from the upper portion of the cap skirt.

U.S. Pat. No. 4,422,559 discloses a plastic container and closure which may be repeatedly snapped together. The closure has an outer skirt and an inner concentric flange providing a channel to receive a container rim. A tear strip on the container is located adjacent the lower edge of the closure skirt in order to prevent access to the lower edge of the closure skirt without destructive removal of the tear strip.

Various other prior art tamper resistant packages only provide marginal leak protection which often results in messy spills and result in odors from the sample collected. Further, other prior art packages are structurally vulnerable in that side pressure in the rim area of the package often causes deformation and breaking of the pilfer band. Other problems associated with the prior art tamper resistant packages are readily known.

SUMMARY OF THE INVENTION

In accordance with the present invention there is provided a tamper resistant wide mouth package which is primarily suited to efficiently and conveniently administer urine sampling. Since the procedure of testing and analysis is based on mass production, there is a need to give the urine testee reasonable assurance that his or her sample is secured, confidential and not subject to mix-up or alterations. A tamper resistant design, combined with a practical testing procedure, is therefore one objective of this invention.

The tamper resistant wide mouth package of the present invention provides a convenient and fast tampering check along with leak protection seals and radial stability in order to prevent damage during shipment or testing procedures. In one embodiment of the invention, the package includes a container having a channel-like rim profile in which a closure is sealingly engaged. In another embodiment, a container has an angled interior surface which matingly engages a closure having complementary mating surfaces which also do not allow for pilfering or tampering efforts to go unnoticed. The closure fits snugly within the container such that the closure cannot be removed without destroying the integrity of at least a portion of the closure, thereby allowing for easy observation of any tampering evidence.

Testing procedures conducted using the tamper resistant package of the present invention are both sanitary and convenient. After the sample is collected, the closure securely seals the sample within the container for safe delivery to a testing site or laboratory. The closure contains a target area which defines a scored disc for opening the package. When the scored disc is pierced by the testing personnel an opening is defined within the closure for withdrawal of the sample contained in the container. If necessary, the opening in the closure can be resealed for storage using a plug that has a tab for easy removal to obtain access for secondary testing. Further, if necessary, for secondary sampling, again the opening in the closure can be resealed for storage using a special plug which forms a tamper resistant seal. The plug extends into the opening and provides a tamper resistant surface. The plug can be repierced, and a sample withdrawn from the container. Such plug can also be replaced and again tamper sealed for even tertiary sampling.

For further understanding of the present invention and the objects thereof, attention is directed to drawings and description thereof, to the detailed description of the invention and to the appended claims.

DESCRIPTION OF THE DRAWINGS

FIG. 36 is an enlarged fragmentary perspective view of an alternative embodiment of a container and a closure, showing the closure in a sealed position on the container.

FIG. 37 is a fragmentary plan view of the container and closure depicted in FIG. 36.

FIG. 38 is a view taken along the line 38–38 in FIG. 37 showing the closure in a sealed position on the container.

FIG. 39 is a fragmentary elevational sectional view of still another embodiment of a container and a closure, showing the closure in a sealed position on the container.

FIG. 40 is a fragmentary elevational sectional view of still another embodiment of a container and a closure, showing the closure in a sealed position on the container.

FIG. 41 is a fragmentary elevational sectional view of still another embodiment of a container and a closure, showing the closure in a sealed position on the container.

FIG. 42 is a fragmentary elevational sectional view of still another embodiment of a container and a closure, showing the closure in a sealed position on the container.

DESCRIPTION OF THE INVENTION

The invention relates to a wide mouth tamper resistant package having an easily detectable tamper resistant closure. While the package is primarily designed for use in collecting samples, such as in urine drug testing, the tamper resistant package of the present invention can also be used in the food and chemical industry.

The package of the present invention allows for a quick and convenient check of evidence of tampering. The test personnel, merely by glancing at the top of the package, can see signs of tampering without having to handle the package itself. Any pilfer attempt to the package cannot be repaired. The package of the present invention includes a container and a closure which form a plurality of seals when the container and closure are closed together in order to prevent package leaking.

The container and closure define additional rim reinforcements which prevent deformation or breaking of the seals.

The tamper resistant package of the present invention also provides for stacking of the closure and the container separately as well as stacking of the filled package. In addition, the closure can be removeably attached to the bottom of the container for ease in distribution to the testee.

Figure 1:
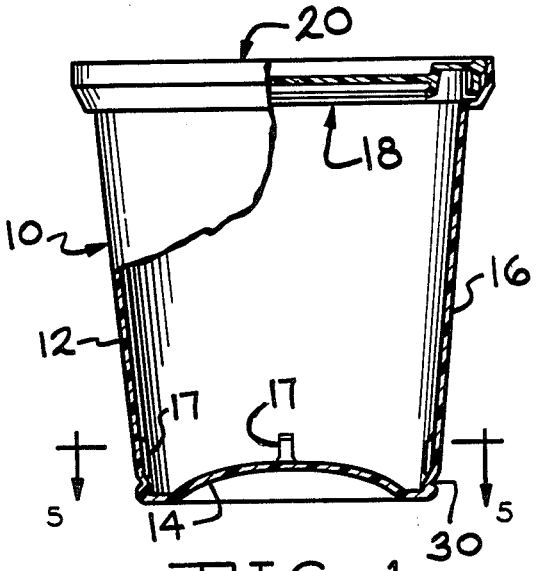
FIG. 1 is an elevational sectional view of a tamper resistant package in accordance with the present invention.

As shown in FIG. 1, a package 10 comprises a container 12 and a closure 20. The container 12 and closure 20 are shown as being substantially cylindrical in shape, but it should be understood that other shapes can be used without departing from the scope of the invention. The container and closure are preferably made of a pliable plastic material which will bend in thin cross section, for purposes described below, such as low or high density polyethylene, polypropylene, or a combination thereof, or blends of polyethylene and polypropylene or other suitable resins providing the desired flexibility and strength properties. The materials can be opaque, translucent, or transparent as required for pertinent applications. The materials can be further of an FDA approved medical grade to avoid chemical leaching into the testing sample and possibly altering the test results. The materials also can be of a food grade, biaxially oriented, multilayered or heatset to satisfy the food industry requirements for specific products, and with regard to barrier properties and heat stability. The container and closure of this invention may be advantageously produced by the injection molding process of the suitable pliable plastic material. The volume of the container is defined by the capacity requirements of the test for which it is to be used, as will be explained below.

Figure 4:
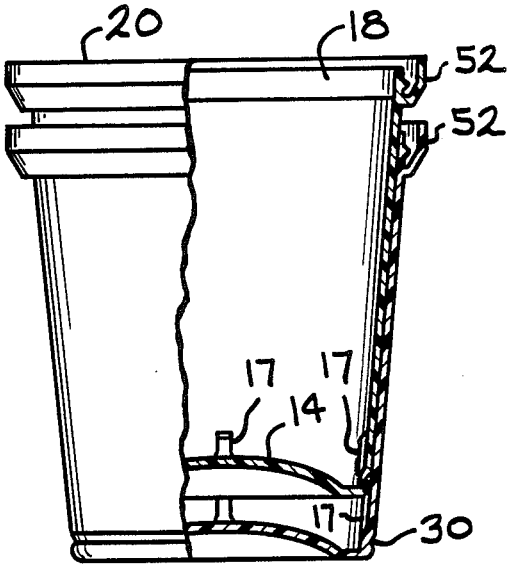
FIG. 4 is an elevational sectional view of a plurality of containers arranged in a stacking relationship.
Figure 5:
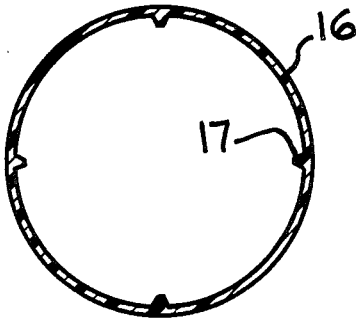
FIG. 5 a sectional view taken along line 5—5 in FIG. 1.

The container 12 generally has a closed end 14, side walls 16 and an open end 18. The open end 18 is sealed by the closure 20. The container 12 further includes a plurality of internal ribs 17 extending radially inward from the side walls 16 of the container 12 at a position near the closed end 14 of the container 12. As can be seen in FIG. 4, the vertical stacking height of the containers 12 is determined by the internal ribs 17. The closed end 14 of one container rests on the internal ribs 17 of an adjacently stacked container 12. The internal ribs 17 allow the containers to be shipped in the stacked position, as shown in FIG. 4, thus using very little shipping space and also protecting the rather fragile outerwall 52. Further, FIG. 5 shows a preferred distribution for the internal ribs 17 disposed along the interior of the side walls 16 of the container 12.

Figure 2:
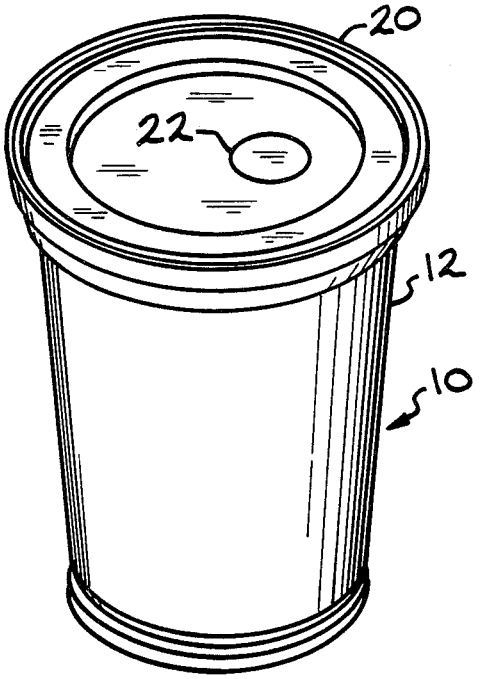
FIG. 2 is a perspective view depicting the package of FIG. 1.
Figure 3:
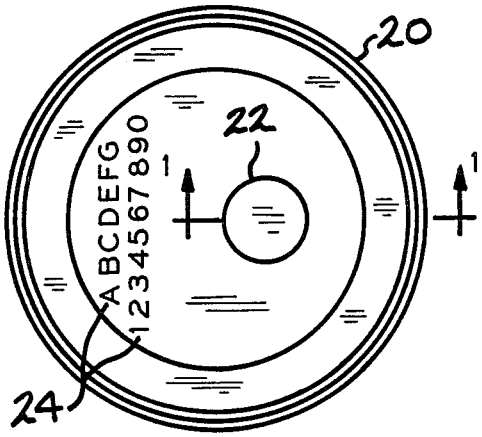
FIG. 3 is a top view of the package depicted in FIG. 1.

Referring now to FIG. 2, the package 1 0 is shown in a perspective view. The closure 20 includes a target area 22 where the closure 20 is to be opened or punctured, as will be explained in detail below. FIG. 3 shows a top view of the closure 20 having identifying indicia 24 such as a lettering or numbering system which is used for an identification system in the testing procedures or for freshness dating of chemicals or food. The closures 20 can be stacked, as shown in FIG. 6, so that the closures 20 can also be shipped in the stacked position, thus using very little shipping space.

Figure 7:
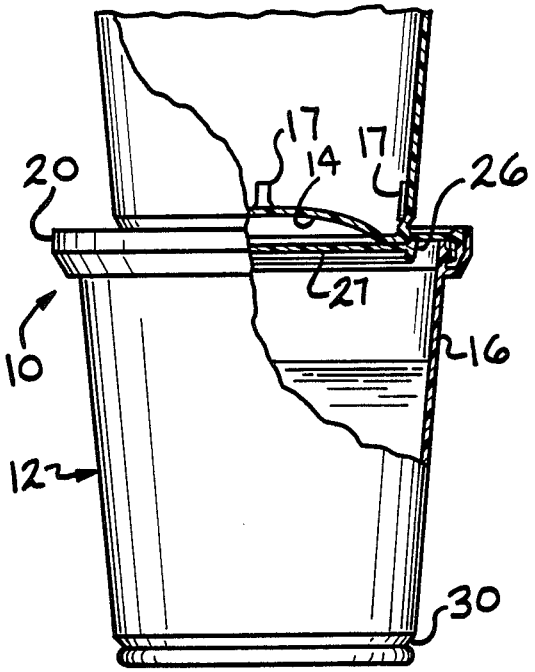
FIG. 7 is a fragmentary elevational sectional view of a plurality of sealed packages arranged in a stacking relationship.

Referring now to FIG. 7, filled packages are shown, as would be normally shipped to a testing location. The closure 20 has a top surface 27 which defines a recess 26. The recess 26 is complementary in diameter to the diameter of the closed end 14 of the container 12. A filled package can then be placed on top of an adjacent filled package such that the closed end 14 of the first container snugly fits into the recess 26 of the closure 20 of the second container. The recess 26 allows the filled packages to be stacked in a stable manner. This stacking feature is also useful in laboratories where packages may need to be stored for rechecking or resampling purposes. Further, the recess 26 has a recess profile which is designed slanted and has a radius such that no tools can be applied to lift off or unsnap the closure 20 from the container 12. In addition, the top surface 27 of the closure 20 can have a rough surface, such as radial or peripheral grooves or a sandblasted texture, which makes any suction cup type removal of the closure ineffective.

Figure 6:
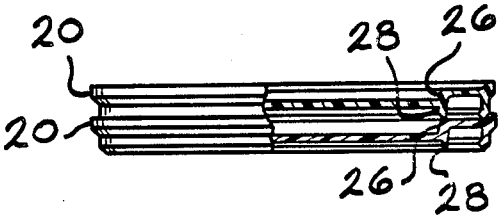
FIG. 6 is an elevational sectional view of a plurality of closures arranged in a stacking relationship.
Figure 8:
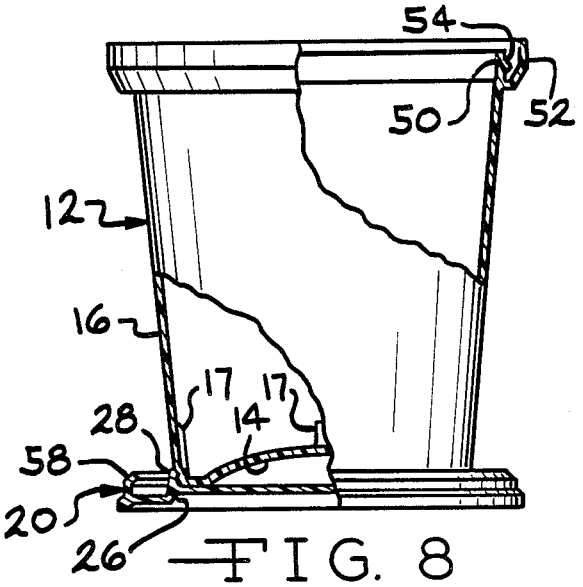
FIG. 8 is an elevational sectional view of a package showing a closure attached to the bottom of a container.

The closure 20 includes a retainer ring 28, as best seen in FIGS. 6 and 8, which extends radially downwardly from the closure 20. The retainer ring 28 allows the closure 20 to be snapped onto the closed end 14 of the container 12, as best seen in FIG. 8. In a preferred embodiment, the closed end 14 of the container 12 further defines an annular groove 30 which facilitates snapping of the closure 20 onto the closed end 14 of the container 12. The retainer ring 28 allows the container 12 with the attached closure 20 (containing the necessary identifying indicia 24 on the closure 20) to be handed to a testee.

Figure 9:
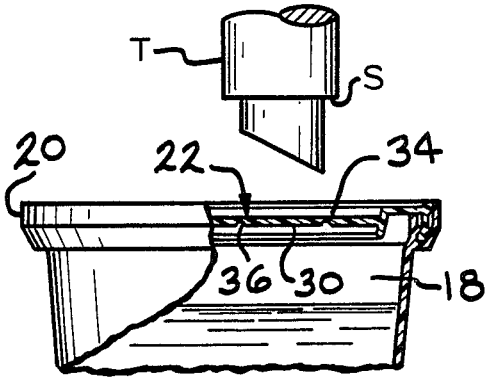
FIG. 9 is a fragmentary elevational sectional view of a piercing tool positioned above a package.
Figure 10:
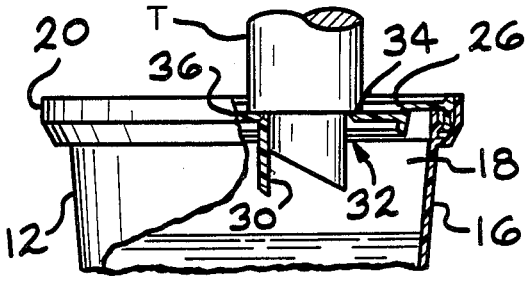
FIG. 10 is a fragmentary elevational sectional view depicting the piercing tool positioned in the closure and depicting the closure in its open form.

Referring now to FIGS. 9 and 1 0, a tool T is shown positioned above the package 10 for use by the testing personnel in order to penetrate through the predetermined target area 22 on the closure 20. The target area 22 defines a scored disc 30 and a groove 34 which extends around the scored disc 30. When the tool T is used to apply pressure at the target area 22, the groove 34 tears or detaches from the adjacent portion of the closure 20. The target area 22 also defines a folding portion 36 which serves as a hinge to permit the free end of the scored disc 30 to be bent downwardly with respect to the target area 22. As the tool T is pushed downwardly the disc 30 is folded aside and also downward into the open end 18 of the container 12. The tool T has a shoulder step S which prevents the tool from entering the wet sample area. When the tool T is inserted through the closure 20, the scored disc 30 remains attached to the closure 20 at the folding portion 36. When the tool T penetrates the target area 22 an opening 32 is created in the closure 20, as can be best seen in FIG. 10. In a preferred embodiment, the tool T starts to penetrate at one point of the periphery of the target area 22 opposite the folding portion 36, such that a scissor-like cutting action takes place, facilitating the creation of the opening 32. The opening 32 allows the testing personnel to withdraw a sample from the package 10 using a pipette or other suitable device. The scored disc 30 does not fall inside the container 12, thus preventing possible debris from contaminating or altering the sample.

Figure 11:
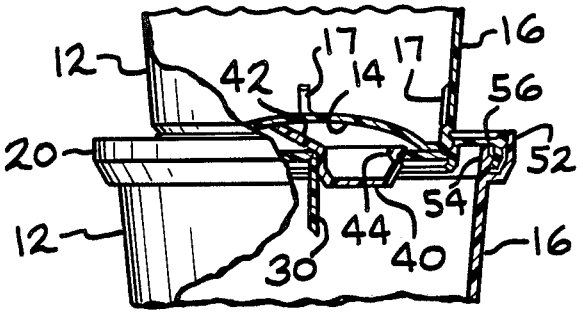
FIG. 11 is a fragmentary sectional view of a package having a plug inserted into an opened closure and arranged in a stacking relationship with an adjacent package.
Figure 12:
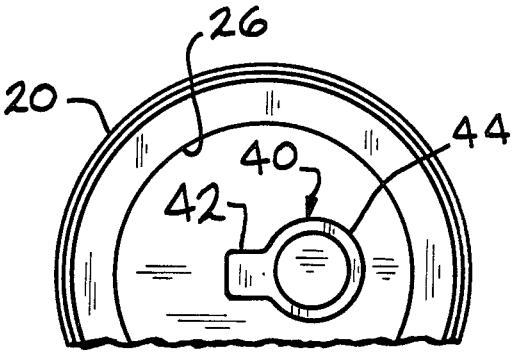
FIG. 12 is a fragmentary top view of a package having a plug inserted in a closure on a package.
Figure 13:
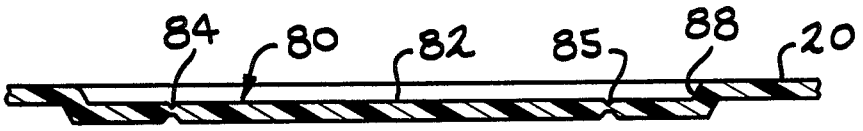
FIG. 13 is a fragmentary elevational sectional view of an alternative embodiment of a closure showing the portion through which the closure is opened.

Referring now to FIGS. 11 and 12, a molded plug 40 can be inserted into the opening 32 on the closure 20 if the sample must be stored for retesting. The plug 40 prevents objectionable odors or leaking of material from the package 10. The plug 40 includes a tab 42 and a radially extending flange member 44. When the plug 40 is positioned within the opening 32, the radially extending flange member 44 sealingly engages the target area 22 around the opening 32. The tab 42 is positioned at an acute angle away from the plug 40 such that the tab 42 does not interfere with the closed end 14 of an adjacently stacked filled package. The closed end 14, in a preferred embodiment, has a domed shape, thus preventing the closed end 14 of the adjacent container from interfering with the tab 42 on the plug 40. When the sample in the filled container is to be retested, the testing personnel merely grasps the tabs and pulls the plug 40 from the opening 32.

Figure 14:
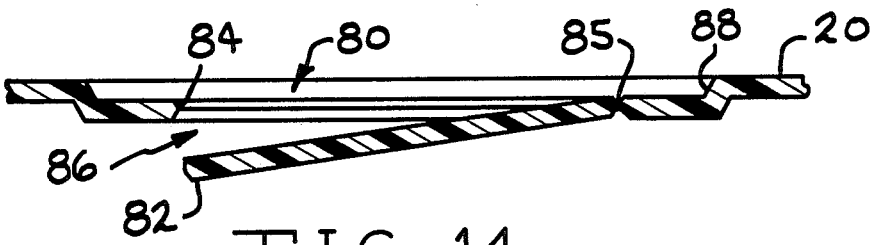
FIG. 14 is a view similar to FIG. 13 depicting a step in the opening of the closure.
Figure 15:
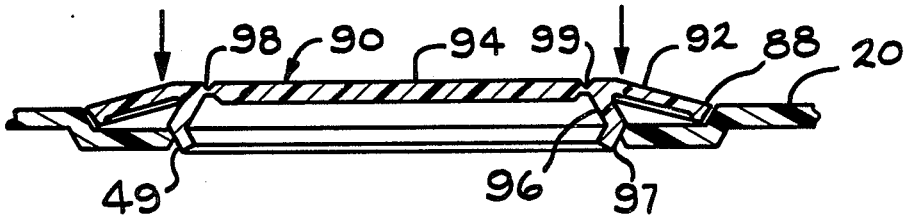
FIG. 15 is a view similar to FIG. 14 in which the closure is being resealed by the positioning of a plug within the opening on the closure.
Figure 16:
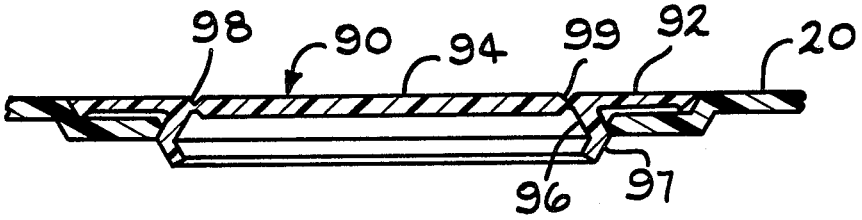
FIG. 16 is a view similar to FIG. 15 showing the plug in a sealing engagement with the closure.
Figure 17:
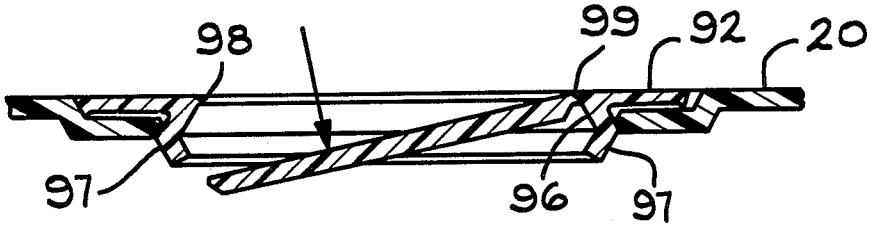
FIG. 17 is a view similar to FIG. 16 depicting a step in the opening of the plug.

The closure 20 once opened, can be resealed for storage and further testing with a special tamper resisting plug, if desired. Referring now to FIGS. 13 through 17, a portion of the closure 20 is shown. In such case, the closure 20 includes a target area 80, a scored disc 82, and a recess 88 extending around the target area 80. As shown in FIG. 14, when the closure 20 is penetrated scored disc 82 separates from the target area 80 at a first groove portion 84 and at a second groove portion 85, thus creating an opening 86 within the target area 80. Or, as an alternative, the disc 82 can be separated only at one groove portion while the other groove portion serves as a hinge (not shown). If the sample is to be saved for retesting a further plug 90, as shown in FIG. 15, can be inserted in the opening 86. The plug 90 includes a radially extending flange 92, a target area 94, and a depending annular skirt 96. When the plug 90 is positioned within the opening 86 the radially extending flange 92 sealingly engages the recess 88 on the closure 20. Pressure is applied in the direction as shown by the arrows in FIG. 15 to the plug 90. The depending annular skirt 96 further includes a distal protrusion 97 which extends downwardly and inwardly from the depending annular skirt 96 at an acute angle such that when pressure is applied to the plug 90 the depending annular skirt 96 flexes inwardly. As the plug 90 is secured within the opening 86 the annular skirt 96 and distal protrusion 97 are sealingly snapped within the opening 86 such that the closure 20 again has a flat tamper resistant surface.

The target area 94 of the plug 90 further defines a first groove portion 98 and a second groove portion 99 which extends radially around the surface of the plug 90. After storage of the package the plug 90 can be pierced along the circular groove portions 98 and 99 such that a further sample can be withdrawn from the package. For a possible further retesting, the pierced plug 90 can be removed from the pierced opening 86 and replaced with a new plug (not shown). The plug 90 can be used with any of the closure embodiments shown.

Figure 18:
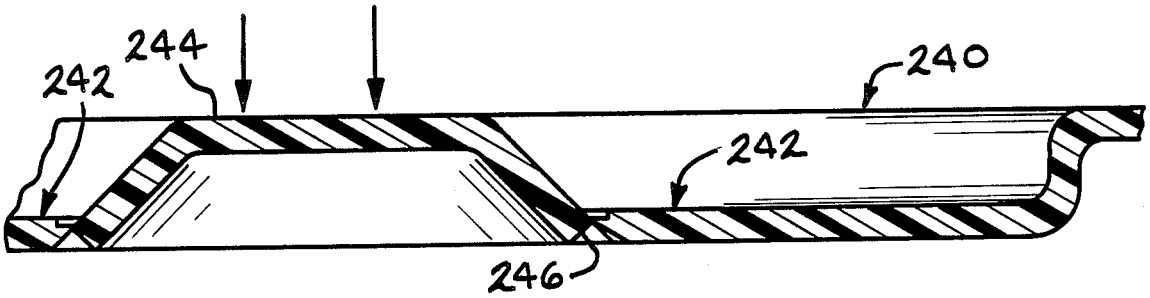
FIG. 18 is an enlarged fragmentary elevational sectional view of an alternative embodiment of a closure showing a protruding piercing portion in its sealed position on the closure.

Referring now to FIG. 18, a portion of yet another embodiment of a closure 240 is shown which has a surface area 242 and a target area 244. The surface 242 of the closure 240 defines the target area 244 which extends upwardly in a direction away from the surface 242 of the closure 240. The target area 244 extends at an acute angle from the surface of the closure 240 and further defines a tear portion 246. The tear portion 246 has a relatively thin cross section such that when the handler wishes to remove a sample from the container the handler merely applies pressure in the direction of the arrows as shown in FIG. 18 to the target area 244. In the preferred embodiment, the cross section of the tear portion 246 is approximately 0.003 of an inch. The target area 244 is torn away from the closure 240 at the circular tear portion 246. This can be accomplished merely by pressing downwardly with the thumb or blunt tool on the top of the target area 244. This alternative opening can be used with any of the closures depicted in the drawings of this invention.

Figure 19:
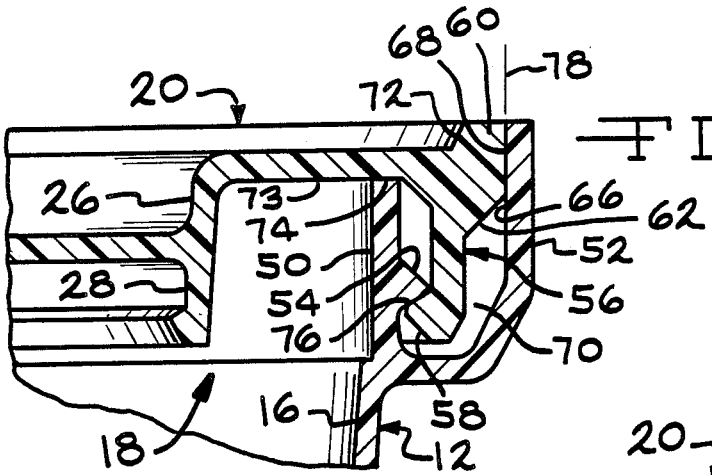
FIG. 19 is a fragmentary elevational sectional view of a closure and a container, showing the closure in a sealed position on the container.
Figure 20:
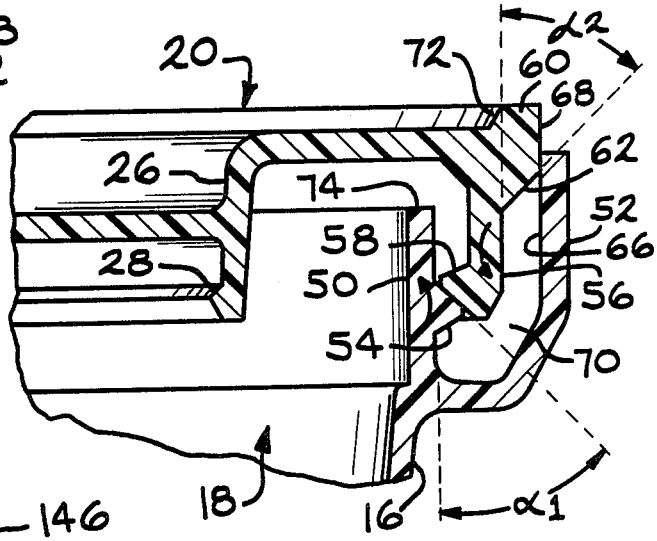
FIG. 20 is a view similar to FIG. 19 in which the closure is depicted at a stage during the sealing of the closure on the container.

Referring now to FIGS. 19 and 20, a portion of the side wall 16 of the container 12 having a closure 20 attached thereto is shown. The side wall 16 of the container 12 terminates at a rim area which defines an inner wall 30 and an outer wall 52. The outer wall 52 extends radially outward and axially upward in a direction toward the open end 18. The inner wall 50 of the side wall 16 includes an engaging means or ridge 54 which extends radially outward in a direction toward the outer wall 52.

The closure 20 is provided with a depending annular skirt 36. The depending annular skirt 56 further includes an engaging means or ridge 58 which extends radially inward toward the inner wall 50 of the container 12. The closure 20 further includes an annular sealing member 60 adjacent the depending annular skirt 56. The annular sealing member 60 defines an angled surface 62 which extends radially outwardly toward the outer wall 52 of the container 12. Referring now to FIG. 20, the beginning step of the sealing of the closure 20 on the container 12 is shown. A guiding chamfer angle $\alpha 1$ is defined by the ridge 54 and the ridge 58 and by the inner wall 50 of the side wall 16. Another guiding chamfer angle $\alpha 2$ is defined by depending annular skirt 56 and the angled surface 62 of the annular sealing member 60. The angles $\alpha 1$ and $\alpha 2$ are provided to help center the closure 20 on the container 12 in order to obtain a quick and proper assembly of the closure 20. The diameter defined by the ridge 58 on the depending annular skirt 56 of the closure 20 is slightly larger than the diameter defined by the ridge 54 on the inner wall 50 of the side wall 16. Angle $\alpha 1$ helps to prelocate the two diameters such that before the closure and container are sealingly engaged, the angled surface 62 of the angular sealing member 60 at the $\alpha 2$ angle also starts a secondary centering in order to ease the closure 20 into an interference fit on the container 12.

At the stage shown in FIG. 20, a vertical force is needed in a downward direction in order to snap the closure 20 onto the container 12. During this audible snapping procedure, the depending annular skirt 56 is flexing radially outward while the inner wall 50 is flexing radially inward, as indicated by the arrows.

As shown in FIG. 19, the closure 20 fits within the container 12 forming a tight interference fit between an interior surface 66 of the outer wall 52 and an exterior surface 68 of the annular sealing member 60. The surfaces 66 and 68 form a tight interference fit engagement such that these interfering surfaces are the only location where the closure 20 can be tampered with. Any tampering deformation of the outer wall 52 can be readily seen since the outer wall 52 is sufficiently thin such that it is quite vulnerable to damage caused by tampering. The wall 52 is slightly under tension, and any pilfer damage (cuts) would spread the wall 52 apart, making it difficult to repair. In preferred embodiments, the outer wall 52 will be approximately 0.03 inches thick. Any damage to the outer wall 52 would be visible by looking down onto the package 10, thus allowing for a fast and convenient way of checking for pilferage attempts without handling the package. The package does not need to be turned in the testing personnel's hand in order to allow side inspection.

The inner wall 50 and the outer wall 52 of the side wall 16 provide rigidity to the container 12 thus minimizing side load stress on the container 12 caused either during shipment or by a tamper's attempt to disengage the closure 20 from the container 12. Further, the inner wall 50 and outer wall 52 define a U-shaped channel 70 which will catch drippings of sample material thus providing a cleaner, drier filling procedure. Further, the U-shaped channel 70 protects the depending annular skirt 56 from disengagement attempts and, at the same time provides clearance for the depending annular skirt 56 as it flexes radially outward during the closing procedure.

Further, as can be clearly seen in FIGS. 19 and 20, a top surface 71 of the closure 20 defines a recess 72 which is in opposing relationship to the depending annular skirt 56 and which allows individual closures to be stacked for shipping from a manufacturer to a distributor. The recess 72 has a recess profile which is designed slanted and has a radius such that no tools can be applied to lift off or unsnap the closure 20 from the container 12. In addition, the top surface 71 of closure 20 can have rough structure, such as radial or peripheral grooves, or a sandblasted texture, which makes any suction cup type removal of the closure ineffective.

Also, the retainer ring 28, clearly seen in FIGS. 19 and 20, allows the closure 20 to be attached to a container 12 in a reversed direction, as clearly shown in FIG. 8. The testee is handed both the container 12 and closure 20 snapped together to remind him to separate the closure 20 from the container 12 only after the container 12 is filled. The closure should not be attached to the open end 18 of the empty container 12 because the closure 20 cannot be removed once it is positioned on the open end 18 without destroying the tamper resistant features of the package.

Since the filled package normally must be shipped from a testing site to a laboratory site for analysis and because rough handling during transportion is anticipated, it is important that the packages are properly sealed. Further, since laboratory personnel are entitled to receive clean and odor free samples in order to facilitate their work, the package of the present invention therefore provides three sealing surfaces. The first sealing surface 74 can be seen in FIG. 19 where the inner wall 50 engages a lower surface 73 of the closure 20; the ridges 54 and 58 provide a second sealing surface 76 when the closure is in the closed position; and, the engagement of the exterior surface 68 of the annular sealing member 60 with the interior surface 66 of the outer wall 52 provide a third sealing surface 78. In addition, there is pretension built into the inner wall 50 in order to provide a sealing pressure effect at the first seal 74 as well as at the second seal 76. Each seal works individually in order to provide protection from leakage of the package.

Figure 21:
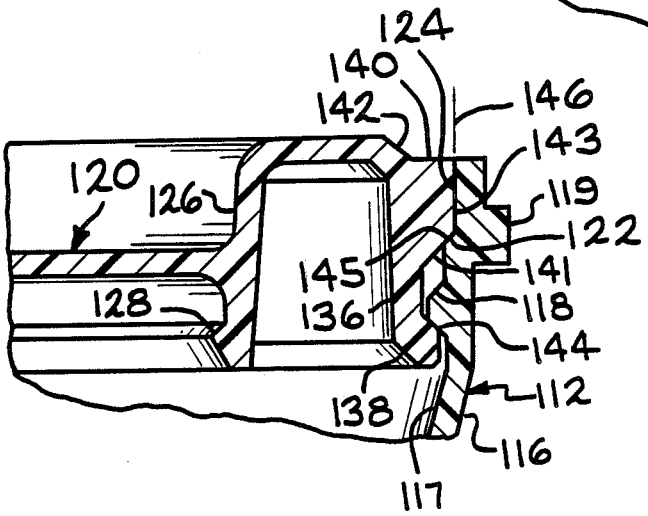
FIG. 21 is a fragmentary elevational sectional view of an alternative embodiment of a container and a closure showing the closure in a sealed position on the container.
Figure 22:
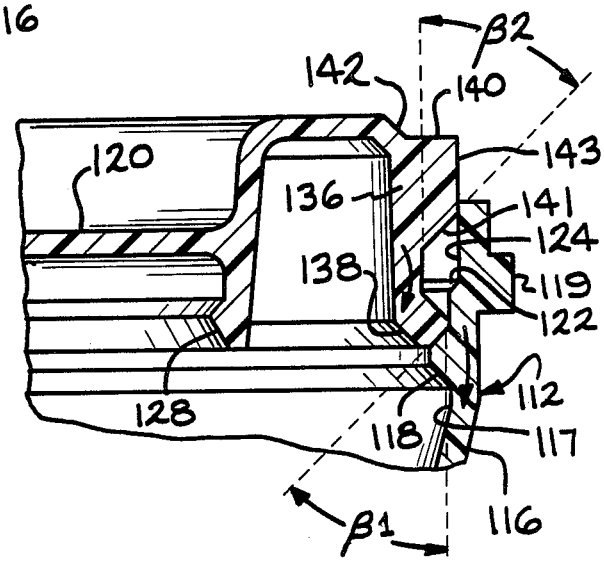
FIG. 22 is a view similar to FIG. 21 in which the closure is depicted at a stage during the sealing of the closure on the container.

An alternative embodiment of the package of the present invention is shown in FIGS. 21 and 22 wherein the container 112 has a side wall 116 and a closure 120. The side wall 116 defines an inner surface 117 which includes an engaging means or ridge 118 extending radially inward, an angled surface 122 and a vertical surface 124. In addition, the container 112 can be provided with a reinforcing ring protrusion 119 extending radially outward from the sidewall 116 in order to provide additional radial stability to the container, if desired.

The closure 120 defines a recess 126 and a retaining ring 128 having similar purposes to the recess 26 and retaining ring 28 on the embodiment shown in FIGS. 19 and 20. The closure 120 includes a depending annular skirt 136. The depending annular skirt 136 further includes an engaging means or ridge 138 which extends radially outward toward the side wall 116 and a radially extending annular sealing member 140 having an upwardly and outwardly angled surface 141 and a vertical surface 143. The closure 120 further deflnes an angled surface 142 which extends radially outward from the top surface of the closure 120 in order to allow the closures to be stacked in a vertical relationship (not shown).

Referring now to FIG. 22, the beginning step of the sealing of the closure 120 on the container 112 is shown. A guiding chamfer angle $\beta 1$ is deflned by the ridge 118 and the ridge 138 and by the inner surface 117 of the side wall 116. Another chamfer angle $\beta 2$ is defined by the depending annular skirt 136 and by the angled surface 141 of the annular sealing member 140. The angles $\beta 1$ and $\beta 2$ are provided to help center the closure 120 on the container 112 in order to obtain a quick and proper assembly of the closure 120 on the container 112. The diameter defined by the ridge 118 on the side wall 116 is slightly larger than the diameter defined by the ridge 138 on the depending annular skirt 136. Angle $\beta 1$ helps to prelocate the two diameters such that before the closure 120 and the container 112 are sealingly engaged, the angled surface 141 of the annular sealing member 140 at the $\beta 2$ angle also starts a secondary centering in order to ease the closure 120 into an interference fit on the container 112.

At the stage shown in FIG. 22, a vertical force is needed in a downward direction in order to snap the closure 120 onto the container 112. During this audible snapping procedure, the depending annular skirt 136 is flexing radially inward while the wall 116 is flexing radially outward, as indicated by the arrows.

The container 112 and closure 120 provide three sealing areas, as seen in FIG. 21: the adjacent edges of the ridges 118 and 138 provide a first sealing surface 144; the angled surface 141 and the angled surface 122 provide a second sealing surface 145; and the vertical surface 143 and the vertical surface 124 provide a third sealing surface 146.

The following testing procedure is designed to be used in combination with the above-described embodiments. The testing procedure lends itself to fast and convenient mass testing, and also providing for the testee's confidentiality and reasonable assurance that mix-ups of samples will not occur. The containers and closures, as well as the plugs and opening tools, can be manufactured by an injection molding process. The closures are coded with a combination of letters and numbers such as prefixes and suffixes. The containers, closures, plugs and opening tools are packaged into one box and shipped to a testing location. For example, each box would contain containers and closures stacked and sealed in a plastic foil tube, plugs packaged in a plastic bag, and at least one piercing tool.

At the testing site the testee is handed a container with the coded closure attached to the bottom of the container. The testee is asked not to attach the closure to the top of the container before the container is approximately one-half filled. In many environments the actual filling of the container is performed with a witness present in order to avoid any foul play. The closure is then snapped onto the container and cannot be removed without causing visible damage to the container. The closed sealed container is given to a person who enters the code number listed on the closure into a computer together with various other pertinent information. A computer printout is then received by the testee. If the testee agrees with the information contained on the computer printout up to this point, the testor and the testee will sign the printout which then becomes a document designed for the protection of the testee. The computor information is then stored safely in a computer bank.

Since the filled package is tamper resistant, there is reasonable assurance that the package will not be tampered with by any person during its shipment to a laboratory testing site. The packages can then be stacked in specially locked shipping containers and shipped to the testing site. The laboratory personnel at the testing site receive clean and dry filled containers which can be readily observed for evidence of ta mpering. The trusted laboratory personnel then receives a computor check list (without personal identifying information thereon) to which he matches the sa mple package code number with a computer code number. The laboratory personnel either using his thumb or a special piercing tool opens the package, analyses the sample, and enters the results into the computer. If the analysis of the sample must be repeated after a period of time, the laboratory personnel can use the plug to reseal the package to ensure that no foreign matter can enter and that no odors escape the package. The sample is then stored. After the test results are received in the general computer bank, the test results are correlated with the testee's name and a printout with results and further instructions are sent to the testee.

Figure 29:
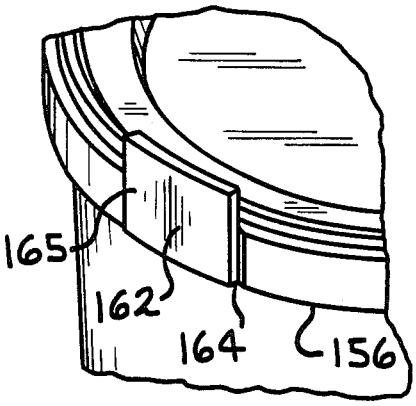
FIG. 29 is a fragmentary perspective view of the closure and container of FIG. 23 depicting the closure in its sealed position on the container.
Figure 30:
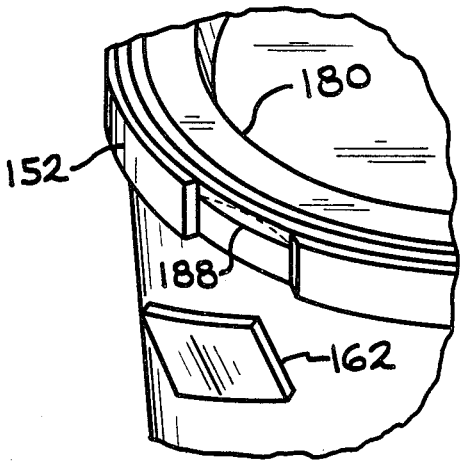
FIG. 30 is a view similar to FIG. 29 showing the removal of the tab portion from the container.
Figure 23:
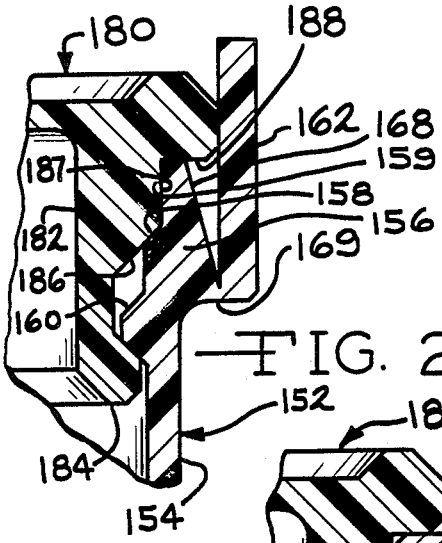
FIG. 23 is a fragmentary elevational sectional view of an alternative embodment of a container and a closure, taken along the line 23—23 in FIG. 27 showing the closure in a sealed position on the container.
Figure 25:
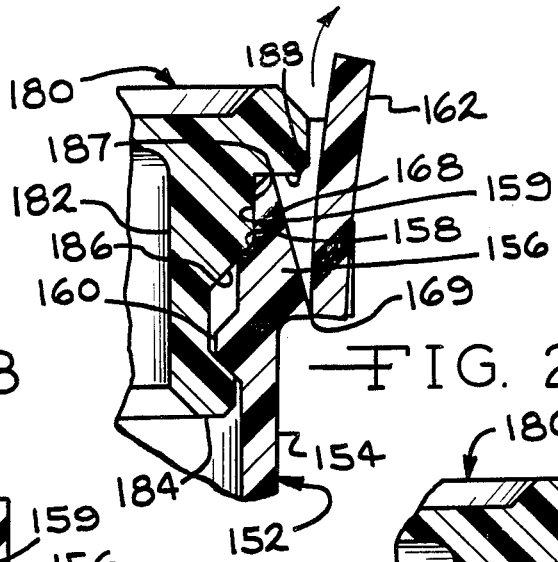
FIG. 25 is a view similar to FIG. 23 showing a tab portion being removed from the container.
Figure 24:
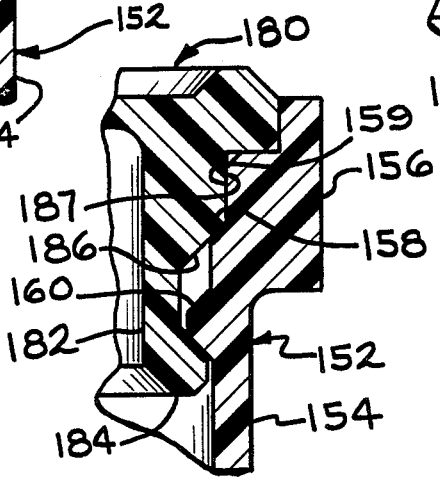
FIG. 24 is a view similar to FIG. 23, taken along the line 24—24 in FIG. 27 showing a further portion of the alternative embodiment of the container and closure.
Figure 26:
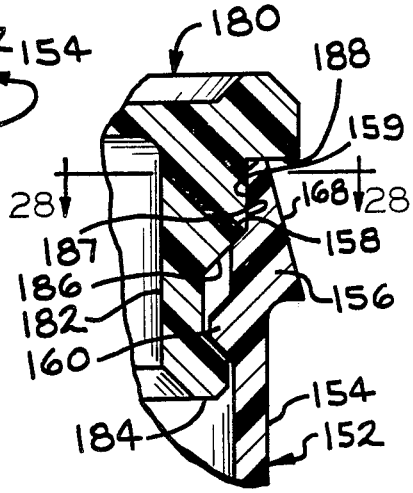
FIG. 26 is a view similar to FIG. 25 showing the closure and the container after the tab has been removed.
Figure 27:
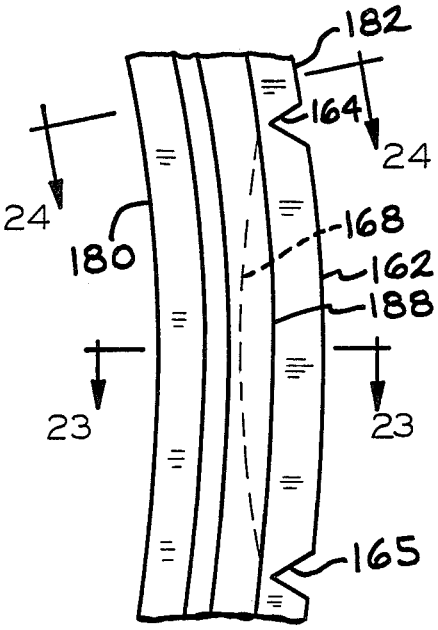
FIG. 27 is a fragmentary top view of the alternative embodiment shown in FIG. 23 of the container and closure depicting the tab portion attached to the container.
Figure 28:
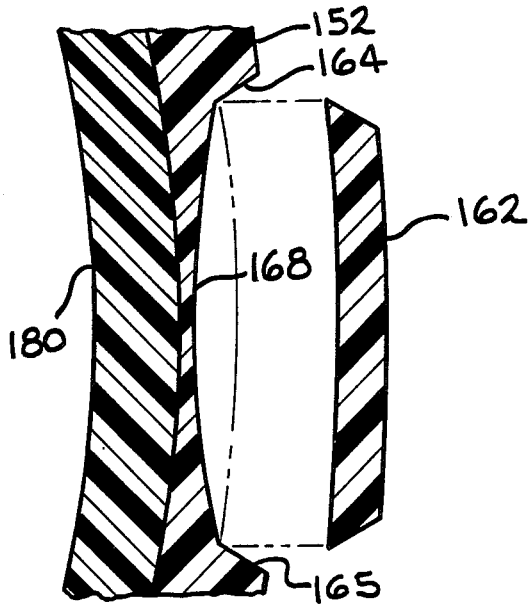
FIG. 28 is a view taken along the line 28—28 in FIG. 26 showing the removal of the tab portion from the container.

Referring now to FIGS. 23–30, alternative embodiments of the package of the present invention is shown. Referring now in particular to FIGS. 23 and 24, a portion of a container 152 and a closure 180 are shown. The container 152 includes a side wall 154 having a distal end 156 which defines an angled interior surface 158 and a vertical surface 159. The side wall 154 further includes an engaging means or ridge 160 which extends radially inward. The container 152 further includes a tear tab portion 162 attached to the distal end 156 of the side wall 154, as best seen in FIGS. 23, 27 and 29. The tear tab portion 162 is defined by vertical tear grooves 164 and 165, as best seen in FIG. 27. The distal end 156 of the side wall 154 further defines an indentation area 168 in opposed relationship to the tear tab portion 162. The tear tab portion 162 is attached to the side wall 154 by a thin connecting section 169. In the preferred embodiments the connecting section 169 is approximately 0.03 of an inch thick. The indentation area 168 tapers inwardly and upwardly from the connecting section 169 to a depth which is less than the outer diameter of the closure 180, as clearly seen in FIGS. 23 and 25.

The closure 180 is sealingly positioned within the container 152. The closure 180 includes a depending annular skirt 182 having an engaging means or ridge 184 which extends radially outward in a direction toward the side wall 154. When the closure 180 is sealingly engaged within the container 152, the ridge 184 forms a sealing engagement with the ridge 160 on the side wall 154 of the container 1 52. The closure 180 defines an angled surface 186 which matingly engages the angled interior surface 158 of the side wall 154 of the container 152, and further defines a vertical surface 187 which matingly engages the vertical surface 159 of the side wall 154 of the container 152. In addition, the closure 180 further defines a protrusion 188 which extends radially outward from the depending annular skirt 182 adjacent the indentation area 168 on the container 152.

The package embodiments as shown in FIG. 23 to 30 are primarily used for the food and chemical industry and not for drug testing. Access to the product stored in the package is gained by removing the entire closure, whereas access for the drug testing package embodiment is gained by puncturing a hole in the closure. When the container 152 is to be opened, the tear tab portion 162 is forced radially outward from the container 152 such that the tear tab portion 162 separates at the connections 164, 165 and 169, as can be best seen in FIGS. 25, 28 and 30. The closure 180 is then removed from the container 152 by applying upward force in the indentation area 168 against the protrusion 188 such that the closure 180 unsnaps from the container 152. The indentation area 168 allows the handler to have sufficient fingerspace in which to apply an upward force against the protrusion 188. The closure can be replaced or snapped back on many times, and all sealing features remain effective.

Figure 31:
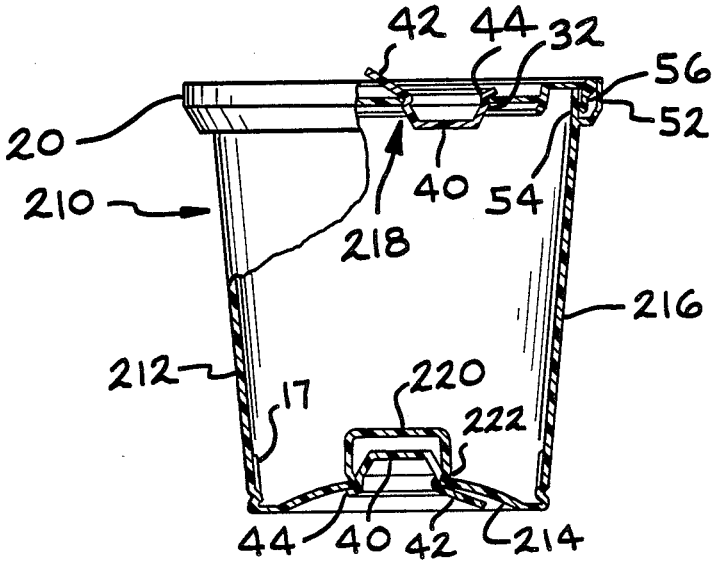
FIG. 31 is an elevational sectional view of an alternative embodiment of a container and closure, showing one plug inserted in the closure and another plug in its storage position on the container.

A further alternative embodiment of a package 210 is shown in FIG. 31. A closure such as the closures 20 shown in FIGS. 1–12 and 19–22 can be positioned on a container 212. The container 212 includes a closed end 214, side walls 216 and an open end 218. Further, a plurality of ribs 217 are positioned on the interior surface of the side walls 216 adjacent the closed end 214. The closed end 214 defines a recessed portion 220 which receives the plug 40. The plug 40 can be attached to the bottom of the container 212 by positioning the plug 40 within the recessed portion 220. The recessed portion 220 further includes a lip 222 which radially extends inwardly such that when the plug 40 is forced in a direction toward the open end 218 the plug 40 snaps into the recessed portion 220 and is held in a sealing engagement in the recessed portion 220 by the lip 222. The plug 40 can then be easily removed by grasping the tab 42 and dislodging the flange member 44 of the plug 40 from the recess portion 220. The plug 40 can then be inserted into the opening 32 in the closure 20.

Figure 32:
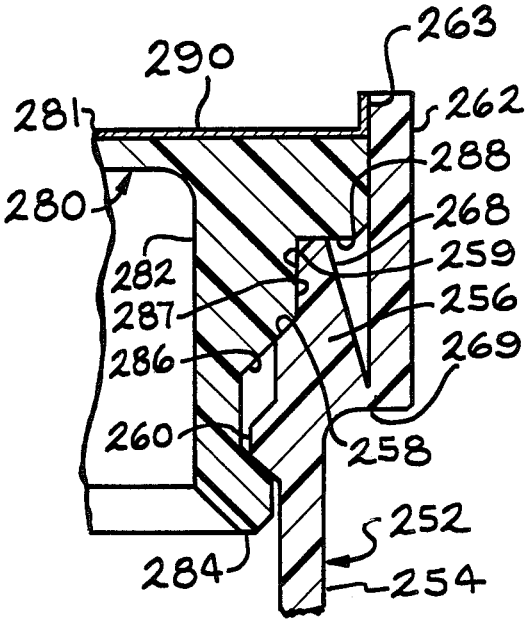
FIG. 32 is a fragmentary elevational sectional view of an alternative embodiment of a container and a closure, showing the closure in a sealed position on the container.
Figure 33:
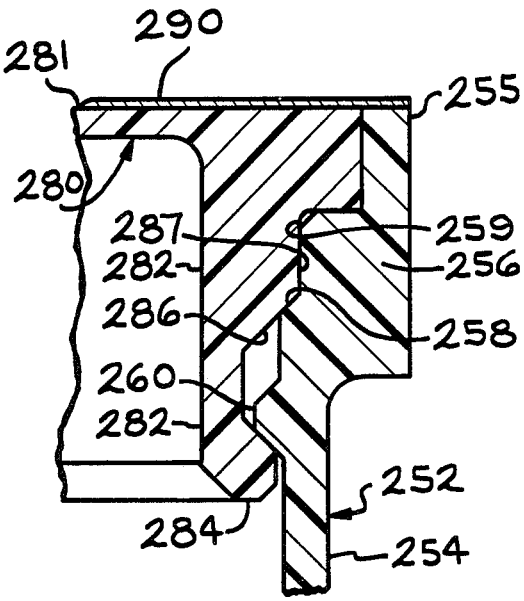
FIG. 33 is a view similar to FIG. 32, showing a further portion of the container and closure.

Referring now to FIGS. 32–35 still another alternative embodiment of the package of the present invention is shown. Referring now in particular to FIGS. 32 and 33, a portion of a container 252 and a closure 280 are shown. The container 252 includes a side wall 254 having a distal end 256 which defines an angled interior surface 258 and a vertical surface 259. The side wall 254 further includes an engaging means or ridge 260 which extends radially inward. The container 252 further includes a tear tab portion 262 attached to the distal end 256 of the side wall 254. The tear tab portion 262 is defined by vertical tear grooves (not shown). The distal end 256 of the side wall 254 further defines an indentation area 268 in opposed relationship to the tear tab portion 262. The tear tab portion 262 is attached to the side wall 254 by a thin connecting section 269. In the preferred embodiments the connecting section 269 is approximately 0.03 inches thick. The indentation area 268 tapers inwardly and upwardly from the connecting section 269 to a depth which is less than the outer diameter of the closure 280, as clearly seen in FIGS. 32 and 34.

The closure 280 is sealingly positioned within the container 252. The closure 280 includes a depending annular skirt 282 having an engaging means or ridge 284 which extends radially outward in a direction toward the side wall 254. When the closure 280 is sealingly engaged within the container 252, the ridge 284 forms a sealing engagement with the ridge 260 on the side wall 254 of the container 252. The closure 280 defines an angled surface 286, which matingly engages the angled interior surface 258 of the side wall 154 of the container 252, and further defines a vertical surface 287 which matingly engages the vertical surface 259 of the side wall 254 of the container 252. In addition, the closure 280 further defines a protrusion 288 which extends radially outward from the depending annular skirt 282 adjacent the indentation area 268 on the container 252.

The container 252 and closure 280 shown in the embodiment in FIGS. 32–35 are particularly useful for storage of food products which are in need of tamper resistant packaging. A plastic, paper or foil label attachment 290 is attached to an upper surface 281 of the closure 280 and extends over a distal portion 255 of the side wall 254, as seen in FIG. 33. Further, as seen in FIG. 32, the attachment 290 extends along an inner surface 263 of the tear tab portion 262. The attachment 290 can be secured by such methods as adhesive bonding (chemical heating), sonic welding (electric energy) or fusion bonding (hot plate welding). The label attachment 290 makes it easier or more obvious to observe evidence of tampering from the top of the package, without the necessity of handling or turning the package. The label attachment makes the package more tamper resistance by adding another seal to the package. The foil not only provides another tamper deterrent, but also a fourth seal plus additional top barrier properties. Further, the manufacturing and application costs of such label attachment are relatively inexpensive. The attachment can be made of a material which stress whitens upon applied tension or scratching. Materials which are suitable for stress whitening include polystyrenes, polypropylenes, polyethylenes and others. These materials produce phase separations which result in light diffraction and opaqueness. In addition, any printing on the label attachment would be distorted by tampering attempts.

Figure 34:
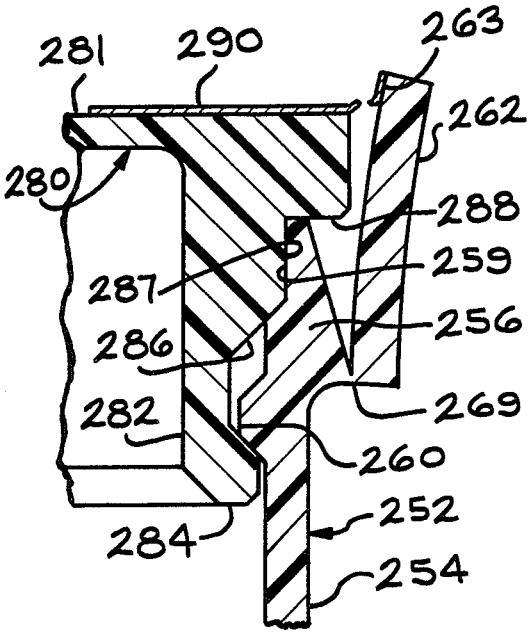
FIG. 34 is a view similar to FIG. 32, showing a tab portion being removed from the container.
Figure 35:
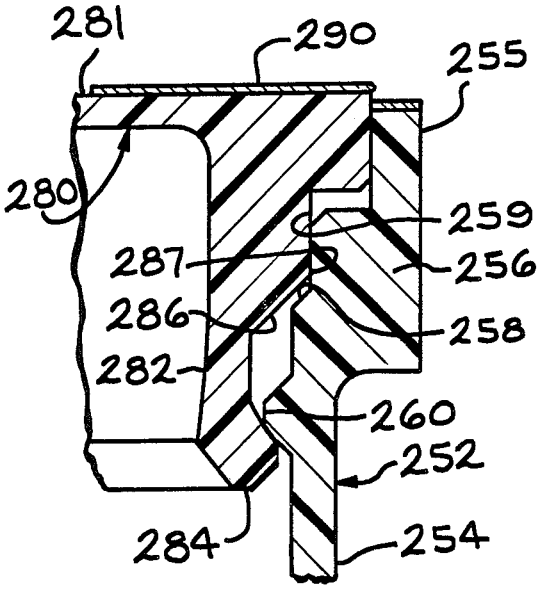
FIG. 35 is a view similar to FIG. 33, showing the closure being removed from the container.

If the package is tampered with, the label attachment 290 is stretched or broken, as shown in FIGS. 34 and 35. The tampering attempt is readily noticeable by visual inspection of the top of the package. When the container 252 is to be opened, the tear tab portion 262 is forced radially outward from the container 252 such that the tear tab portion 262 separates at the connection 269 and the vertical tear grooves (not shown). The closure 280 is then removed from the container 252 by applying upward force in the indentation area 268 against the protrusion 288 such that the closure 280 unsnaps from the container 252. The indentation area 268 allows the handler to have sufficient fingerspace in which to apply an upward force against the protrusion 288.

Referring now to FIGS. 36–42, still other alternative embodiments of the package of the present invention are shown. Referring in particular to FIGS. 36–38, a portion of a side wall 316 of a container 312 having a closure 320 attached thereto is shown. The closure 320 is similar to the closure 20 shown in FIGS. 19 and 20 and includes a depending annular skirt 382 having an engaging means or ridge 384 which extends radially inward. The side wall 316 of the container 312 terminates at a rim area which defines an inner wall 350 and an outer wall 352. The outer wall 352 extends radially outward and axially upward in a direction toward the open end 318 of the container 312. The inner wall 350 of the side wall 316 includes an engaging means of ridge 354 which extends radially outward in a direction toward the outer wall 352. The outer wall 352 defines a purality of indentations 356 extending around the circumference of the outer wall 352.

As shown in FIG. 36, the closure 320 fits within the container 312 forming a tight interference fit between an interior surface 366 of the outer wall 350 and an exterior surface 368 of the depending annular skirt 382 on the closure 320. The surfaces 366 and 368 form a tight interference fit engagement such that these interfering surfaces are the only location where the closure 320 can be tampered with. Any tampering deformation of the outer wall 352 can be readily seen since the outer wall 352 is sufficiently thin at the indentations 356 such that the outer wall 352 is quite vulnerable to damage caused by tampering. The outer wall 352 is slightly under tension, and any pilfer damage would spread the wall apart making it difficult to repair. In preferred embodiments, a portion of the outer wall within the indentation 356 will be approximately 0.01 inches thick, rendering that thin portion frangible if pilfering is attempted. Any damage to the outer wall 352 is visible by looking down onto the package, thus allowing for a fast and convenient way of checking for pilferage attempts without handling the package. The package does not need to be turned in the testing personnel's hand in order to allow side inspection.

Still further, alternative embodiments of a container and a closure of the present invention are shown in FIGS. 39–42. FIG. 39 shows a circumferential chamfer profile 456 which extends radially downwardly and outwardly from an outer wall 452 of a container 412, for rendering pilfering and repair even more difficult.

FIG. 40 shows a circumferential chamfer profile 556 which is defined by a reinforcing ring protrusion 519 extending radially outward from a side wall 516 of a container 512, for the purpose stated above for FIG. 39.

FIG. 41 shows a portion of a side wall 716. Adjacent edges of the closure 720 and the side wall 716 define mating protrusion 722 on the container 720 and protrusion 718 on the side wall 716, respectively. These protrusions 722 and 718 define a ridge which extends circumferentially around the top surface of the package (not shown). Any pilfering attempt will be easily shown by visually examining the protrusions 722 and 718.

FIG. 42 shows a side wall 652 which defines labyrinth type recess 656 on the interior surface 666 of the side wall 652. A closure 620 further includes a radially extending portion 622 which matingly engages the indentation 656.

The best modes known to me to carry out this invention have been described above in terms sufficiently full, clear, concise and exact as to enable any person skilled in the art to make and use the same. It is to be understood, however, that it is within my contemplation that certain modifications of the above-described mode of practicing the invention can be made by a skilled artisan without parting from the scope of the invention and it is, therefore, desire to limit the invention only in accordance with the appended claims.

I claim:

1. A tamper resistant package comprising:

a container having a closed end, at least one side wall, and an open end defined by the side wall, the side walls including radially extending sealing surfaces and an inwardly facing annular sealing surface; and, a closure of plastic material such that the closure flexes in thin cross section, the closure having a depending annular skirt adapted to securely fit within the open end of the container, the depending annular skirt having radially extending sealing surfaces for engaging the radially extending sealing surfaces of the container and for placing the container and closure under tension to secure the closure on the container, the depending annular skirt terminating in an outwardly facing peripheral annular sealing surface adapted to engage said inwardly facing annular sealing surface; the closure snapping into the open end of the container and being sealed under tension such that an attempt to disengage the closure from the container causes visual damage to either the closure or the container which can be seen by observing the package from the top.

2. The package of claim 1 wherein the sealing surfaces of the side wall of the container adjacent the open end define an inner wall and an outer wall, the outer wall extending radially outward and axially upward in a direction toward the open end; the inner wall including a ridge which extends radially outward in a direction toward the outer wall; and, wherein the sealing surfaces of the depending annular skirt of the closure define a ridge which extends radially inward for engaging the ridge on the inner wall of the side wall; the sealing surfaces of the depending annular skirt further defining an annular sealing member having an angled surface which extends radially outward and upward for engaging the outer wall of the side wall when the closure is secured on the container.

3. The package of claim 2 wherein a first guiding chamfer angle is defined by adjacent edges of the ridge on the inner wall of the side wall and the ridge on the depending annular skirt and by the inner wall of the side wall; and, wherein a second guiding chamfer angle is defined by the depending annular skirt and by the angled surface of the annular sealing member; the first and second angles being provided to help center the closure on the container in order to obtain a quick and proper assembly of the closure on the container.

4. The package of claim 3 wherein the inner wall and outer wall define a U-shape channel which protects the depending annular skirt from disengagement attempts and provides clearance for the depending annular skirt as it flexes radially outward when the closure is secured on the container.

5. The package of claim 2 wherein a first seal is defined by engagement of a distal portion of the inner wall of the container with a lower surface of the closure;

a second seal is defined by engagement of adjacent edges of the ridge on the depending annular skirt of the closure and the ridge on the inner wall of the container; and, a third seal is defined by engagement of the annular sealing member of the closure with the outer wall of the container when the closure is secured on the container.

6. The package of claim 5 wherein the inner wall provides a sealing pressure effect at the first seal as well as at the second seal.

7. A tamper resistant package of claim 1 wherein the sealing surfaces of the side wall of the container define a ridge which extends radially inwardly an angled surface and a vertical surface; and, wherein the sealing surfaces of the depending annular skirt of the closure define a ridge which extends radially outward for engaging the ridge on the side wall; the sealing surfaces of the depending annular skirt further defining an annular sealing member having an angled surface which extends radially outward and upward and a vertical surface for engaging the angled surface and the vertical surface of the side wall when the closure is secured on the container.

8. The package of claim 7 wherein a first guiding chamfer angle is defined by adjacent edges of the ridge on the side wall of the container and the ridge on the depending annular skirt and by an inner surface of the side wall; and, wherein a second guiding chamfer angle is defined by the depending annular skirt and by the angled surface of the depending annular sealing member; the first and second angles being provided to help center the closure on the container in order to obtain a quick and proper assembly of the closure on the container.

9. The package of claim 7 wherein a first seal is defined by engagement of adjacent edges of the ridge on the depending annular skirt with the ridge on the side wall;

a second seal is defined by engagement of the angled surface of the depending annular skirt and the angled surface of the side wall; and, a third seal is defined by engagement of the vertical surface of the depending annular skirt with the vertical surface of the side wall when the closure is secured on the container.

10. The package of claim 1 wherein the container further including at least one internal rib extending radially inward from the side wall of the container at a position near the closed end of the container for allowing the containers to be arranged in a vertical stacking relationship.

11. The package of claim 1 wherein the closure further includes an annular recess which is complementary in diameter to the exterior diameter of the closed end of an adjacent container such that the closed end of the adjacent container fits within the annular recess of the closure to allow filled packages to be arranged in a vertical stacking relationship.

12. The package of claim 11 wherein the recess is sloped at an angle such attempts to disengage the closure from the container causes visual damage to either the closure or the container.

13. The package of claim 1 wherein the closure further includes an annular depending retainer ring which extends axially downward from the closure such that the closure can be snapped onto the closed end of the container; and, wherein the closed end of the container further defines an annular groove which facilitates snapping of the closure onto the closed end of the container.

14. The package of claim 1 wherein the side wall of the container adjacent the open end of the container further includes an annular reinforcing protrusion extending radially outward thus providing additional radial stability to the container.

15. The package of claim 1 wherein the closure has a non-smooth upper surface such that suction force cannot be used to disengage the closure from the container.

16. The package of claim 1 wherein the side wall of the container includes a tear tab portion attached to an exterior surface of the side wall by a connecting section and by vertically extending tear groove sections; the exterior surface of the side wall further including an indentation area in opposed relationship to the tear tab portion which tapers inwardly and upwardly from the connecting section; and, wherein the closure further defines a protrusion which extends radially outward adjacent the indentation area on the side wall of the container such that when the container is to be opened, the tear tab portion is forced radially outward from the container, the tear tab portion separating from the side wall at the connecting section and at the tear groove sections, the closure being removed from the container by applying upward force against the protrusion such that the closure unsnaps from the container, the indentation area providing sufficient room in which to apply the upward force against the protrusion.

17. The package of claim 16 wherein a sealing label is secured to an upper surface of the closure and a distal portion of the side wall of the container and is further secured to an inner surface of the tear tab portion such that an attempt to disengage the closure from the container causes visual damage to the label.

18. The package of claim 1 wherein the closure further defines a target area such that when force is applied to the target area at least a portion of the target area detaches from the closure and an opening is formed in the closure.

19. The package of claim 18 wherein the target area on the closure includes a scored portion and a folding portion such that when force is applied to the target area the target area is detached from the closure at the scored portion and remains attached to the closure at the folding portion, the folding portion being pushed downwardly and folded aside into the open end of the container.

20. The package of claim 18 which further includes a removeable plug for insertion into the opening on the closure, the plug including a tab and a radially extending flange member such that the radially extending flange member sealingly engages an area surrounding the opening on the closure; the tab being positioned at an acute angle on the plug such that the tab does not interfere with the closed end of an adjacently stacked filled package.

21. The package of claim 20 wherein the closed end of the container has a domed shape thus preventing the closed end of an adjacently stacked container from interfering with the tab on the plug.

22. The package of claim 20 wherein the closure further defines an annularly extending recess positioned in an opposed relationship to the opening in the closure for receiving a plug;

the plug including a radially extending flange, a target area and depending annular skirt, the radially extending flange on the plug engaging the recess on the closure when the plug is secured in the opening, the depending annular skirt further including a distal protrusion which extends downwardly and inwardly from the depending annular skirt into the opening such that when force is applied to an upper surface of the plug the depending annular skirt flexes inwardly and is secured within the opening; the target area on the plug further defining a tear portion such that when force is applied to the plug target area at least a portion of the plug target area detaches from the plug and an opening is formed in the plug.

23. The package of claim 20 wherein the closed end of the container includes a recessed portion which receives the plug, the recessed portion defining a lip which extends radially inwardly such that when the plug is forced into the recessed portion in a direction toward the open end of the container, the plug snaps into the recessed portion and is held in sealing engagement in the recessed portion by the lip.

24. The package of claim 18 wherein the target area defines a portion which extends upwardly at an acute angle in a direction away from an upper surface of the closure, the extending portion including a tear portion having a relatively thin cross section such that when force is applied to the extending portion in a downward direction toward the closed end of the container, at least a portion of the target area detaches from the closure thus forming the opening in the closure.

25. The package of claim 24 wherein the tear portion has a cross section of approximately 0.003 inches in cross section.

26. The package of claim 1 wherein the side wall of the container further defines a plurality of indentations having a substantially thin cross-section such that an attempt to disengage the closure from the container causes visual damage to at least one indentation which can be seen by observing the package from the top.

27. The package of claim 1 wherein the side wall and closure of the container define mating projections for defining a unitary circumferential protrusion extending upwardly from the container/closure surface, said protrusions being subject to visible pilfer damage.

28. The package of claim 1 a wherein the side wall defines a labyrinth type recess which matingly engages with said recess to provide additional pilfer resistance to said package.

29. A tamper resistant package comprising:

a container having a side wall defining an open end, a closed end connected to the said side wall, a sealing surface radially extending from said side wall, and an inwardly facing annular sealing surface formed on said side wall ajacent said open end; and a closure formed of flexible material having a depending annular skirt adapted to securely fit into said open end of said container, a sealing surface radially extending from said skirt for engaging said radially extending sealing surface of said container and for placing said container and said closure under tension to secure said closure on said container, and an outwardly facing annular sealing surface formed on a periphery of said closure and adapted to sealingly engage said inwardly facing annular sealing surface formed on said container side wall whereby an attempt to disengage said closure from said container will cause visual damage to at least one of said container and said closure which damage can be seen by observing the package from said open end.

* * * * *